US012161182B2

(12) United States Patent
Deshpande et al.

(10) Patent No.: US 12,161,182 B2
(45) Date of Patent: Dec. 10, 2024

(54) HELMET WITH MODULAR COOLING FAN

(71) Applicant: Klein Tools, Inc., Lincolnshire, IL (US)

(72) Inventors: Shantanu Deshpande, Glenview, IL (US); Johnnie Coats, Chicago, IL (US); Ebrahim Kassamali, Plainfield, IL (US)

(73) Assignee: Klein Tools, Inc., Lincolnshire, IL (US)

( * ) Notice: Subject to any disclaimer, the term of this patent is extended or adjusted under 35 U.S.C. 154(b) by 92 days.

(21) Appl. No.: 17/864,156

(22) Filed: Jul. 13, 2022

(65) Prior Publication Data

US 2024/0016252 A1 Jan. 18, 2024

(51) Int. Cl.
*A42B 3/28* (2006.01)

(52) U.S. Cl.
CPC ..... *A42B 3/286* (2013.01)

(58) Field of Classification Search
None
See application file for complete search history.

(56) References Cited

U.S. PATENT DOCUMENTS

| | | | | |
|---|---|---|---|---|
| 4,744,106 | A * | 5/1988 | Wang | A42B 3/286 D29/103 |
| 9,241,529 | B1 * | 1/2016 | Danelski | A42B 3/286 |
| 11,071,881 | B1 * | 7/2021 | Cullen | A41D 13/0025 |
| 11,445,775 | B2 * | 9/2022 | Otey | F04D 17/16 |
| 2009/0255025 | A1 * | 10/2009 | Ochoa | A42B 3/286 2/209.13 |
| 2019/0037949 | A1 * | 2/2019 | Nelson | A42B 1/205 |
| 2020/0300256 | A1 * | 9/2020 | Kennedy | F04D 25/166 |
| 2022/0117347 | A1 * | 4/2022 | Wong | F04D 25/08 |
| 2022/0132973 | A1 * | 5/2022 | Wong | H01M 50/10 2/422 |

* cited by examiner

*Primary Examiner* — Katherine M Moran

(57) ABSTRACT

A safety helmet fan system includes a safety helmet comprising a mount slot and a housing comprising a body having a fan enclosure, a mount configured to engage the mount slot to removably attach the housing to the safety helmet, and a hinge connecting the body to the mount, wherein the mount is engaged to the mount slot and the hinge is configured to allow the body to rotate, relative to the mount, between a cooling position and a stowed position wherein in the cooling position a rotational axis of the fan is below an axis of rotation of the hinge, and in the stowed position the rotational axis of the fan is above the axis of rotation of the hinge.

16 Claims, 8 Drawing Sheets

HELMET WITH MODULAR COOLING FAN

BACKGROUND OF THE DISCLOSURE

The present disclosure relates to personal protection devices and, more particularly, safety helmets for use to protect the wearer from falling objects, impacts, and falls, commonly referred to as "hard hats", and to cooling fans for such helmets. Cooling fans are one type of accessory that have been mounted to safety helmets.

With regards to fans, it is known to integrate fans into the shell of the hard hat, but such constructions require that the fan unit, including its weight and bulk, always be worn by the user, even in conditions that do not require fan cooling. It is also known to utilize bands or brackets or fasteners to mount a fan unit to the hard hat shell, but such mount schemes often require a user to make multiple adjustments or to manipulate multiple threaded fasteners to mount the fan to the hard hat. The ability to easily adjust external fans when use of the fans is not desired or for removal and storage of safety helmets also presents a challenge. The ability to accommodate different brim configurations is another challenge that arises with fan systems that are intended to be removably mounted to a hard hat to allow use with different hard hats.

BRIEF SUMMARY OF THE DISCLOSURE

In accordance with one feature of this disclosure, a safety helmet fan system is provided and includes a safety helmet comprising a mount slot. The safety helmet fan system includes a housing comprising, a body having a fan enclosure, a mount configured to engage the mount slot to removably attach the housing to the safety helmet, and a hinge connecting the body to the mount. When the mount is engaged to the mount slot, the hinge is configured to allow the body to rotate, relative to the mount, between a cooling position and a stowed position. The housing comprises a motor driven fan carried in the fan enclosure. The cooling position a rotational axis of the fan is below an axis of rotation of the hinge, and in the stowed position the rotational axis of the fan is above the axis of rotation of the hinge.

In one feature, the mount is a unitary structure.

According to one feature, the mount is of two-piece construction, wherein a first piece of the mount comprises a releasable connection configured to engage a slot of the second piece of the mount.

As one feature, the safety helmet comprises a protruding brim, and wherein the mount is configured to engage the protruding brim.

In one feature, the fan enclosure comprises louvres configured to allow the user to adjustably direct air from the fan.

According to one feature, the safety helmet fan system further includes a battery configured to mount to an exterior of the safety helmet and a power cable permanently connected to the housing and removably connected to the battery.

As one feature, the mount includes a first clip configured to removably attach to the power cable, and the safety helmet fan system further includes a second clip having a first portion attached to the power cable and second portion configured to removably attach to a brim of the safety helmet.

In accordance with one feature, the safety helmet further includes a second mount slot on a side of the safety helmet opposite the mount slot and the safety helmet fan system further includes a second housing having a second fan housing and second mount configured to engage the second mount slot.

According to one feature, the mount slot is positioned on a first side the safety helmet and the second mount slot is positioned on a second side of the safety helmet opposite the first side.

As one feature, the mount comprises a clip configured to engage the mount slot to removably attach the housing to the safety helmet.

In accordance with one feature, a first portion of the hinge is an integral part of the body, and a second portion of the hinge is an integral portion of the mount.

In one feature, the mount comprises a substantially flat support surface configured to support the safety helmet fan system in the stowed position.

In accordance with one feature of the disclosure, a safety helmet fan system is provided and includes a safety helmet comprising a mount slot and a housing comprising a body having a fan enclosure, a mount configured to engage the mount slot to removably attach the housing to the safety helmet, and a hinge connecting the body to the mount. When the mount is engaged to the mount slot, the hinge is configured to allow the body to rotate, relative to the mount, between a first position and a second position. The housing includes a motor driven fan carried in the fan enclosure and louvres carried on the fan enclosure and configured to adjustably direct airflow from the fan. In the first position an outlet of the fan enclosure is directed in a first direction, and in the second position the fan enclosure is directed in a second direction different from the first direction.

In one feature, in the first position, a rotational axis of the fan is below an axis of rotation of the hinge, and in the second position the rotational axis of the fan is above the axis of rotation of the hinge.

According to one feature, the mount comprises a substantially flat support surface configured to support the safety helmet fan system in the second position.

As one feature, the louvres are configured to rotate relative to the fan enclosure to adjustably direct the airflow from the fan.

It should be understood that the inventive concepts disclosed herein do not require each of the features discussed above, may include any combination of the features discussed, and may include features not specifically discussed above.

DETAILED DESCRIPTION OF PREFERRED EMBODIMENTS

Figure 1:
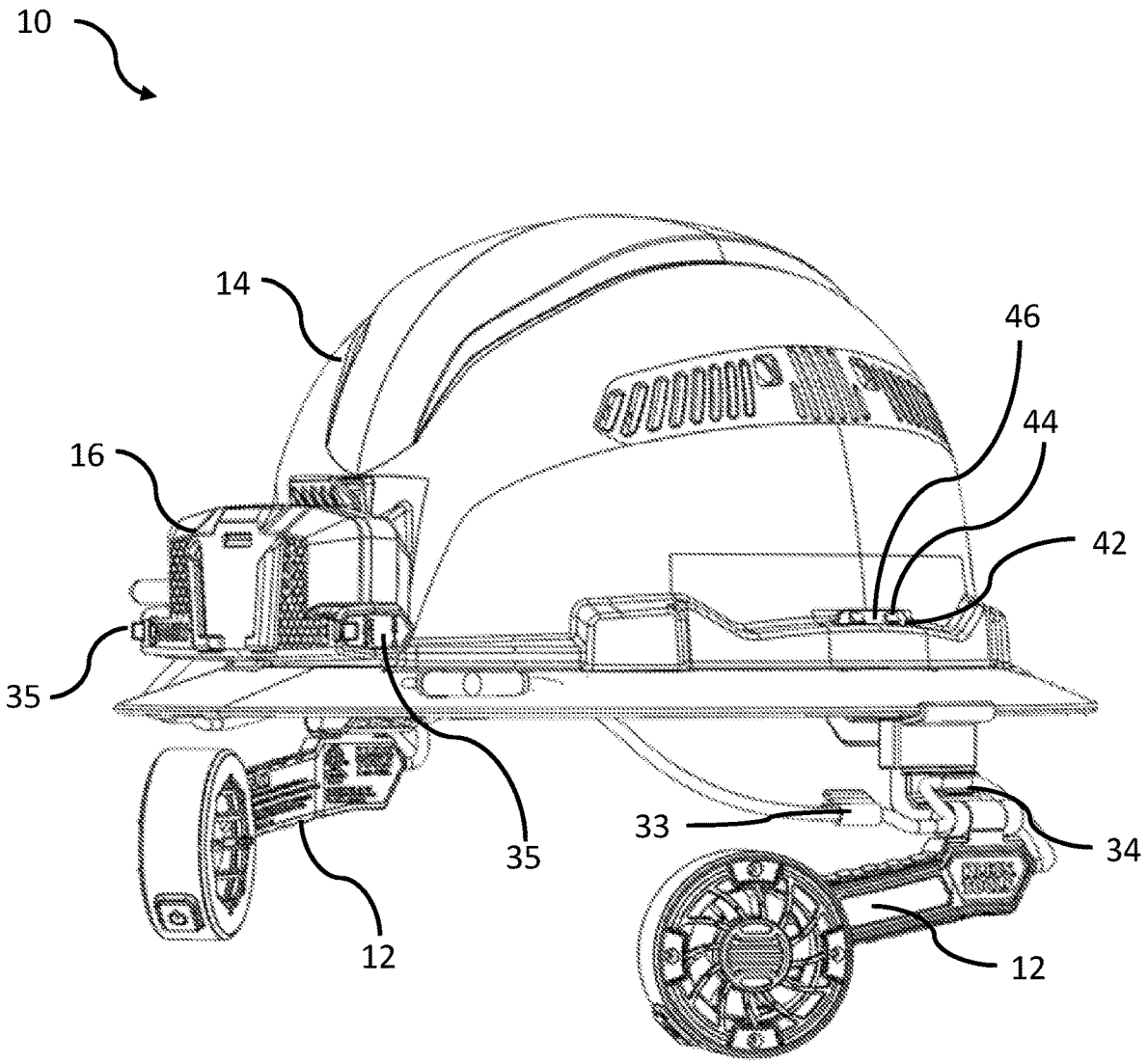
FIG. 1 is a view from the front and side of a full brim safety helmet a pair of modular cooling fans.

As best seen in FIG. 1, a safety helmet fan system 10 is provided for mounting lightweight modular cooling fans 12 to a safety helmet 14 (shown in FIG. 1 in the form of a full brim safety helmet 14). In the illustrated and preferred embodiment, the system 10 includes a power storage component in the form of a power or battery pack 16, with the battery pack 16 being selectively connectable to the helmet 14 by a quick release mount connection.

As shown in FIGS. 4-6 and 9 and as will be explained in greater detail below, the modular cooling fans 12 (e.g., modular fan, lightweight modular cooling fan, lightweight fan) of this disclose allow for fans to be removably mounted to a safety helmet 14 to direct air towards a user of the safety helmet 14. In the illustrated and preferred embodiment, the modular cooling fans 12 are hinged to allow the user to adjust the direction of airflow from the modular cooling fans 12. In the illustrated and preferred embodiment, the modular cooling fans are further configured to rotate such that a stable support surface is provided to set down and store the safety helmet fan system 10 when not in use.

Figure 2A:
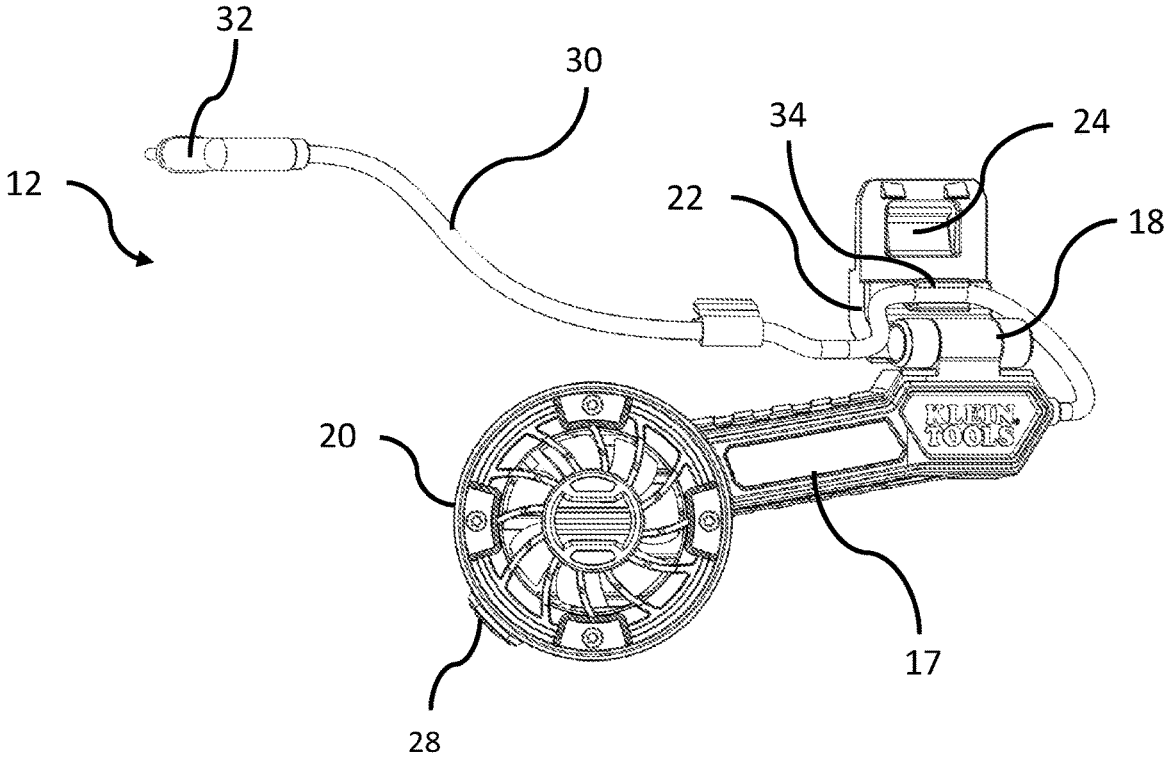
FIG. 2A is a side view of a modular cooling fan.
Figure 2B:
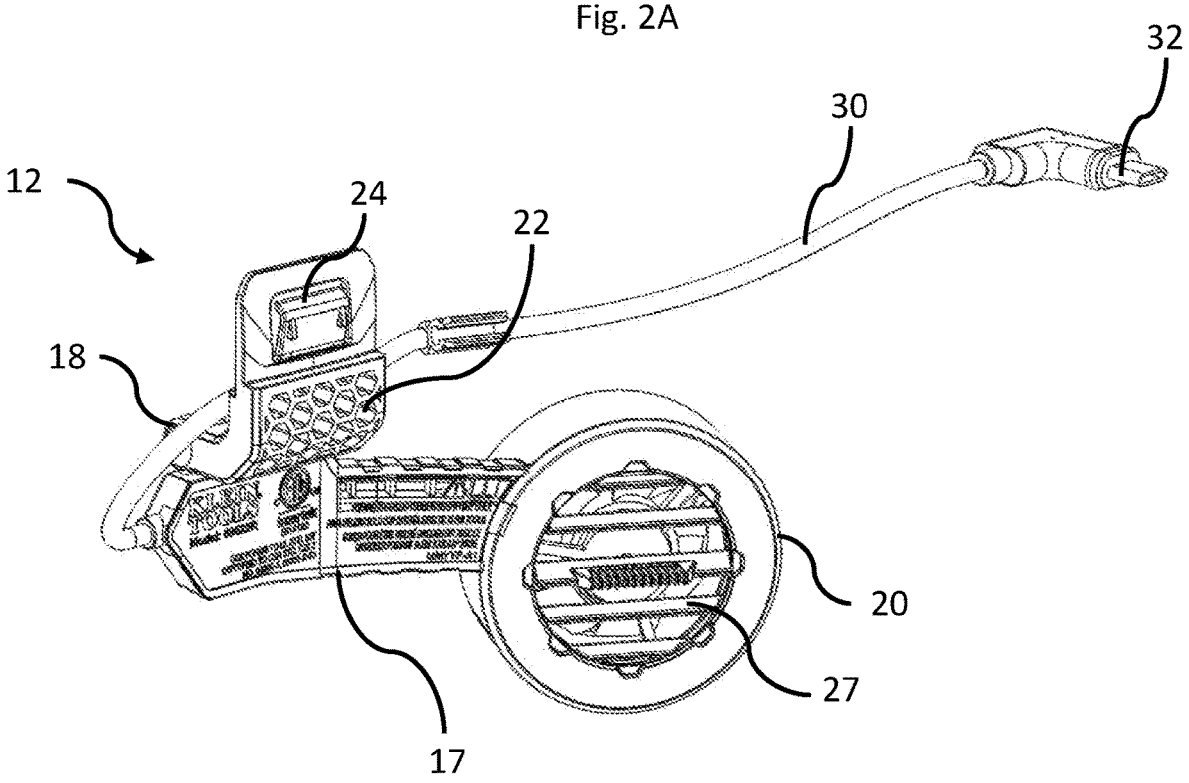
FIG. 2B is another side view of the modular cooling fan of FIG. 2A.
Figure 3:
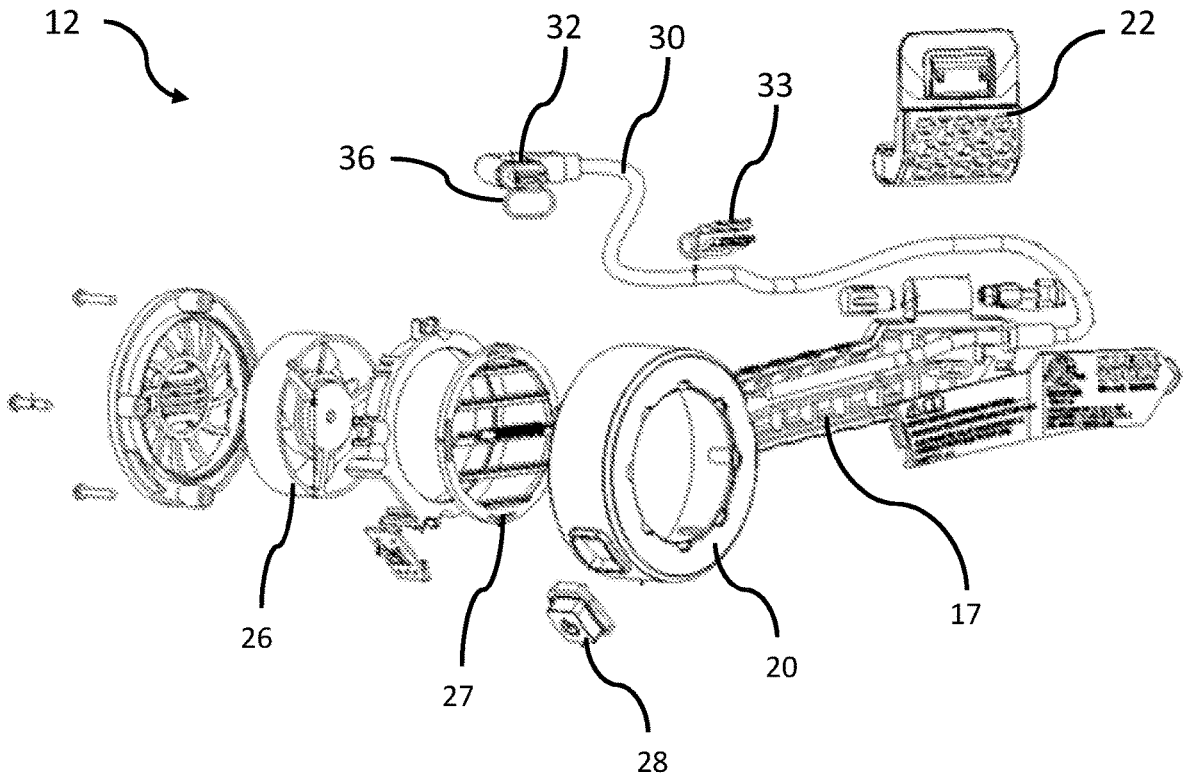
FIG. 3 is an exploded view of the modular cooling fan of FIG. 2A.

As best shown in FIGS. 2-3, the lightweight modular cooling fan 12 includes an elongated body 17 (e.g., body) with a hinge connection 18 at a first end and a fan enclosure 20 at a second end. In the illustrated and preferred embodiment, the hinge connection 18 is on a top portion of the first end and is connected to a mount 22. In the illustrated and preferred embodiment, the mount 22 form a substantially 90-degree angle with the hinge connection 18 at one and a clip 24 at another end. As will be explained in greater detail below, the mount 22 and clip 24 is preferably configured to allow the modular cooling fan 12 to removably attach to the safety helmet 14.

In the illustrated and preferred embodiment and as best shown in FIG. 3, the fan enclosure 20 carries one or more fans 26 (e.g., electric motor driven fans) that can be provided in any suitable form, many of which are known. In the illustrated and preferred embodiment, the fan enclosure further includes louvres 27 configured to adjustably direct air movement from the fan 26. In the illustrated and preferred embodiment, the louvres 27 are angled to redirect air movement, and are configured to rotate relative to the fan enclosure 20. A user wearing the safety helmet fan system 10, for example, may rotate the louvres 27 to adjust and customize the airflow from the fan 26 towards the user. The fan enclosure 20 further includes a user input in the form of a power button 28 or switch (not shown) that is configured to allow a user to switch the fan 26 between at least an on condition wherein the fan 26 is driving a cooling air flow and an off condition wherein the fan 26 is not powered. In a preferred embodiment, the power button 28 may further switch the fan 26 between a low speed on condition and a high speed on condition.

As best seen in FIGS. 1-3, the modular cooling fan 12 further includes a power cord 30 extending from the elongated body 17 and having a suitable electric power connector 32, many of which are known, configured to form an electric power connection with the battery pack 16. In a preferred embodiment, the connector 32 is shown in the form of a USB Type-C male connection and includes an O-ring 36. In the illustrated and preferred embodiment, a cord support clip 33 is provided and is configured to support the power cord 30. In the illustrated and preferred embodiment, the clip 33 is configured to removably attach to a brim of a safety helmet 14. In the illustrated and preferred embodiment, the mount 22 comprises a second cord support clip 34 configured to support the power cord 30.

In the illustrated and preferred embodiment, the power or battery pack 16 includes a battery housing carrying a battery or other suitable power storage device. A battery can be provided in the form of one or more suitable rechargeable or disposable battery cells, many of which are known, depending on the detailed requirements of any particular application for the safety helmet fan system. In the illustrated embodiment, the battery is a multi-cell, rechargeable lithium-ion battery. The battery pack 16 in the illustrated embodiment further includes a pair of electric power connectors or jacks that are accessible via power ports 35 formed in the battery housing, with jack caps being provided to close the ports 35 when the ports 35 are not in use to provide an intrinsic safe design. While any suitable electric power connector/jack, many of which are known, for the ports 35, in one preferred embodiment the ports 35 are provided in the form of USB Type-C female connections. In the illustrated embodiment, the O-ring 36 of the connector 32 create a seal with the ports 35 to provide an intrinsic safe design. In some embodiments, the battery pack 16 further includes a power gage to visually indicate to a user how much power is available in the battery pack 16 and a user activated button (not shown) configured to allow a user to selectively activate the power gage.

Figure 4A:
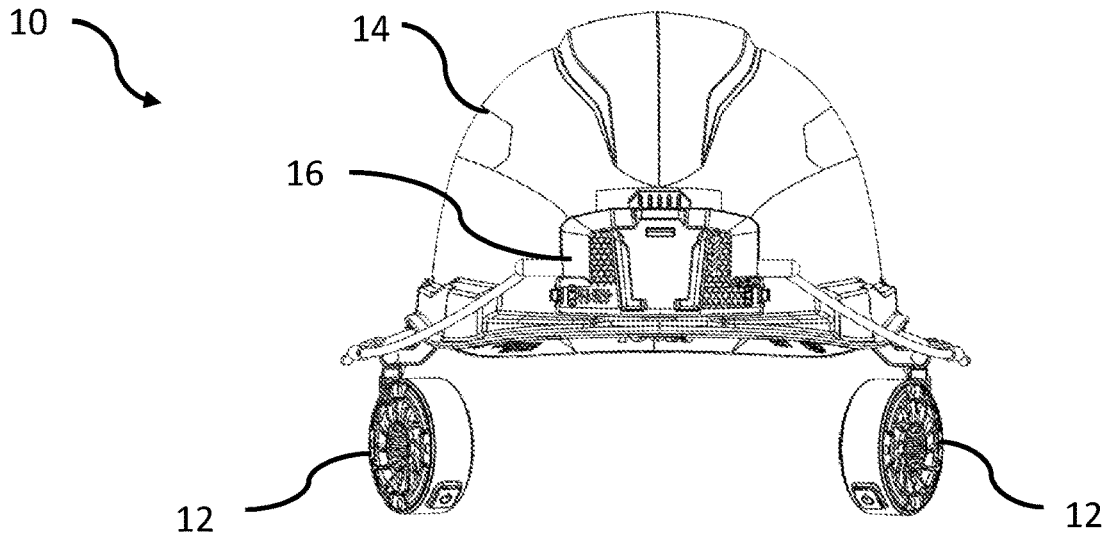
FIG. 4A is rear view of a cap style safety helmet and a pair of modular cooling fans in a cooling position.
Figure 4B:
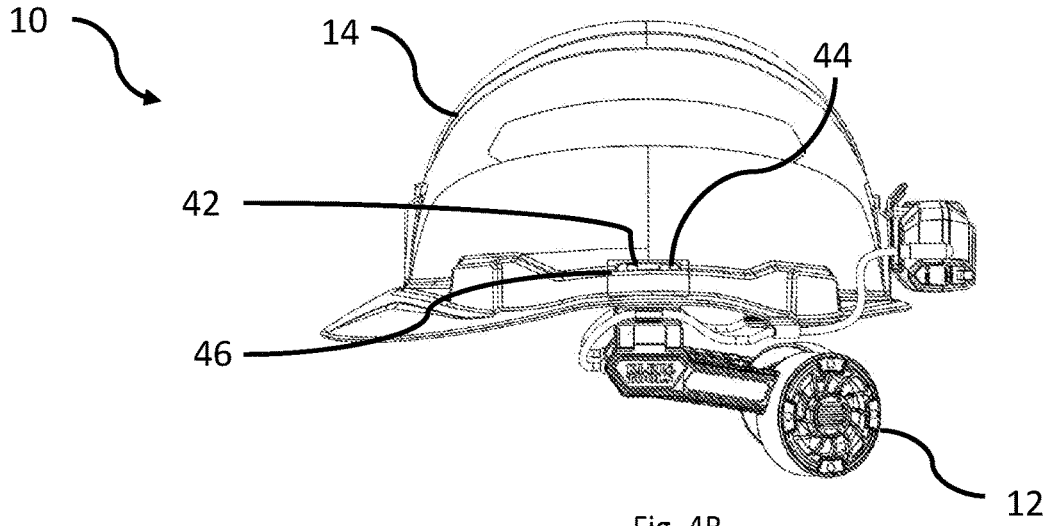
FIG. 4B is a side view of the cap style safety helmet and pair of modular cooling fans of FIG. 4A.
Figure 4C:
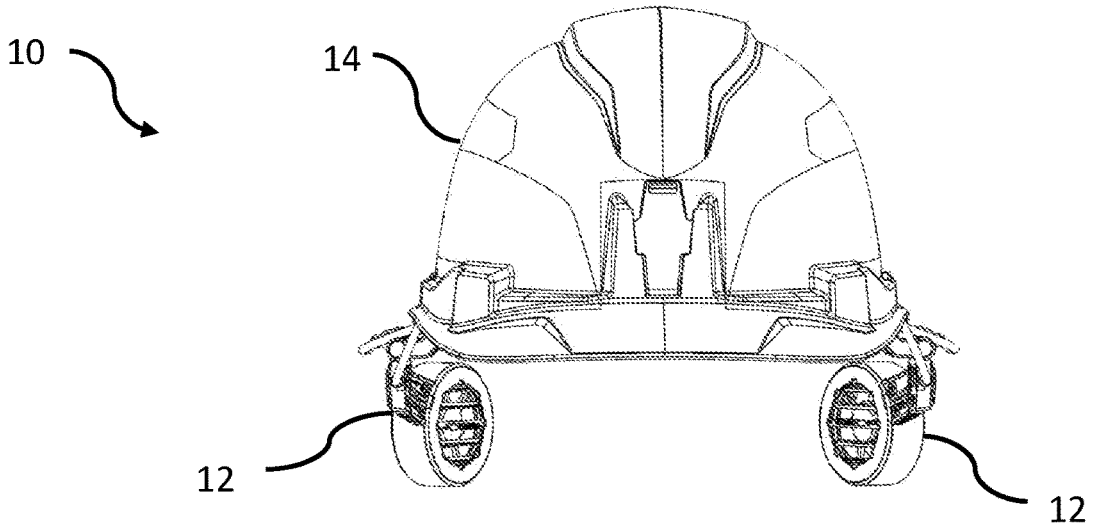
FIG. 4C is a front view of the cap style safety helmet and pair of modular cooling fans of FIG. 4A.

As best shown in FIGS. 4A-4C, in an illustrated and preferred embodiment of the safety helmet fan system 10 with a cap style safety helmet 14. The safety helmet 14 includes a pair of mount slots 42 preferably comprising an opening slot passing from the interior of the safety helmet 14 to the exterior of the safety helmet. In the illustrated and preferred embodiment, each of the mount slots 42 are located on opposite sides of the safety helmet 14. In the illustrated and preferred embodiment, a pair of modular cooling fans 12 are attached to the safety helmet 14, with the mount 22 of each modular cooling fan 12 configured to engage an associated mount slot 42. In the illustrated and preferred embodiment, the mount is shown in the form of a clip with a protruding nub 44 configured to engage an upper surface 46 of the safety helmet 14. As shown in the illustrated and preferred embodiment, the cooling air from the modular cooling fans 12 may be directed towards a user (e.g., wearer of the safety helmet 14). In the illustrated and preferred embodiment, the battery pack 16 may be mounted to the front or rear of the safety helmet 14. In the illustrated embodiment of FIGS. 4A-4C, the battery pack 16 is shown mounted to the rear of the safety helmet 14 and is connected to each of the modular cooling fans 12.

Figure 5A:
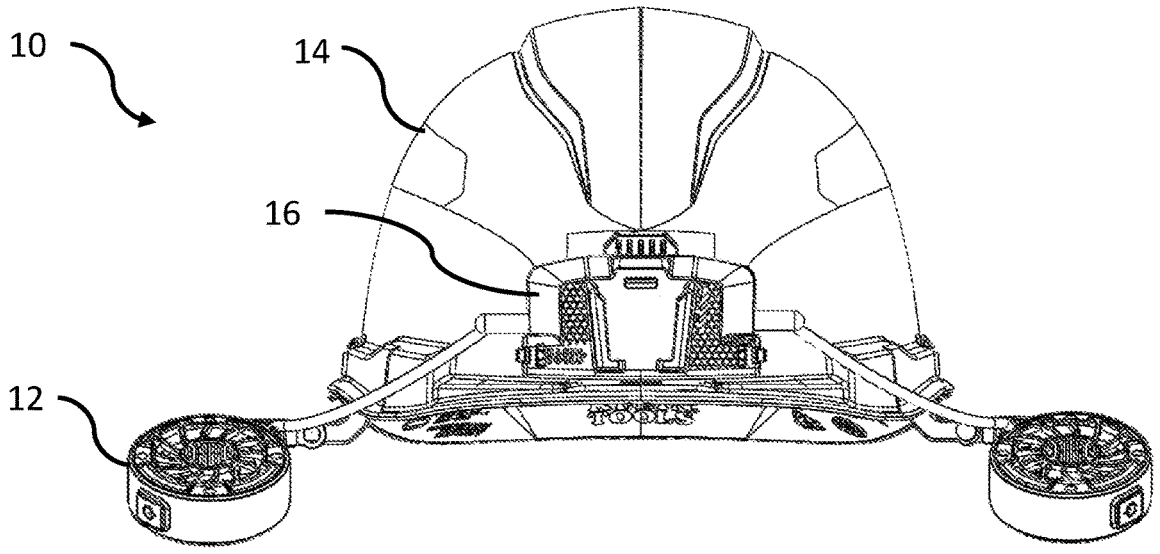
FIG. 5A is a rear view of the cap style safety helmet of FIG. 4A with the modular cooling fans in a side position.
Figure 5B:
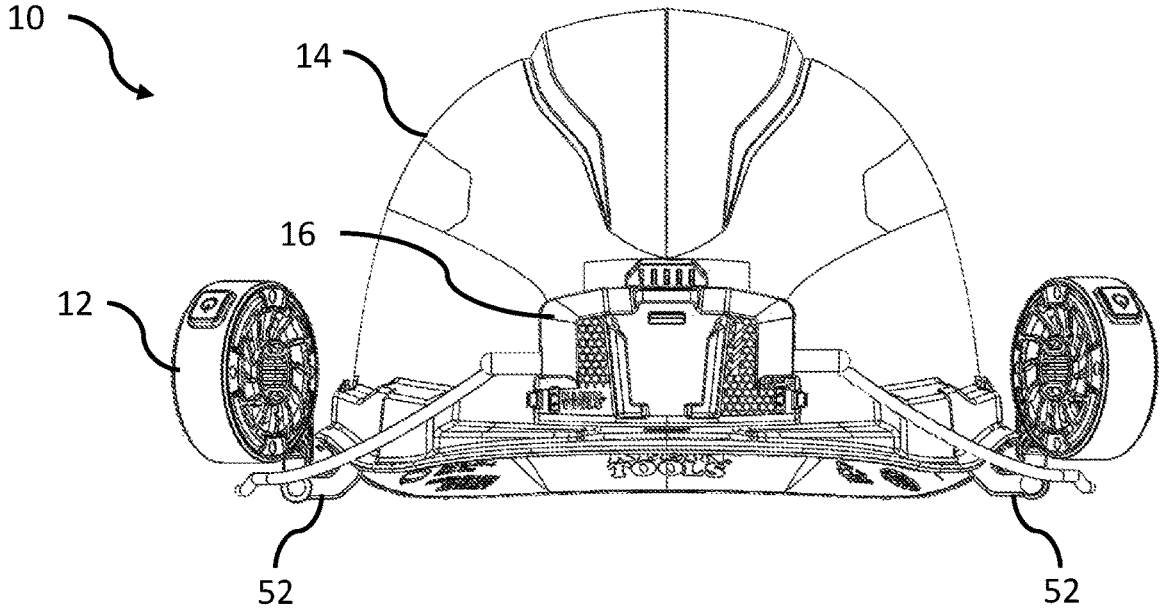
FIG. 5B is a rear view of the cap style safety helmet of FIG. 4A with the modular cooling fans in a stored position.

In the illustrated and preferred embodiment, the hinge connection 18 (e.g., hinge) comprises a first hinge portion 48 that is an integral part of the elongated body 17 and a second hinge portion 50 that is an integral part of the mount 22. As best shown in FIGS. 4A, 5A-5B, the body 17 is configured to rotate, via the hinge connection 18 relative to the mount 22 about a hinge axis of rotation. In the illustrated and preferred embodiment, the modular cooling fan 12 is configured to rotate, via the hinge, to a plurality of positions including at least a cooling position (e.g., first position) shown in FIG. 4A and a stowed position (e.g., second position) shown in FIG. 5B. In the illustrated and preferred embodiment, the hinge connection further allows the modular cooling fan 12 to rotate to intermediate positions (e.g., positions in between the cooling position and the stowed position) as that shown in FIG. 5A. The plurality of positions allows a user of the safety helmet fan system 10 to adjustably direct air emitted by the modular cooling fans 12 to a desired direction.

In the illustrated and preferred embodiment, an axis of rotation of the fan 26 is below the axis of rotation of the hinge connection 18, and air from the fan 26, when worn by a user, is directed towards the user. In a preferred embodiment, a majority of the fan 26 and/or fan enclosure 20 is below the brim of the helmet 14 in the cooling position.

As shown in FIG. 4A, when the modular cooling fan 12 is in the cooling position, in some embodiments, the cooling fan 12 extending below the brim of the safety helmet 14 may interfere with storage of the safety helmet fan system 10, for example, when removing the safety helmet 14 and setting it down on a table. As shown in FIG. 5B, in the stowed position the mount forms a substantially flat support surface 52. In the illustrated and preferred embodiment, support surface 52 provides a stable surface for the safety helmet fan system 10 to rest. For example, a user, after removing the safety helmet fan system 10, may move the cooling fans 12 to the stowed position and set the safety helmet fan system 10 onto a flat surface with the support surface 52 providing a predominantly flat stable surface for the safety helmet fan system 10.

Figure 6A:
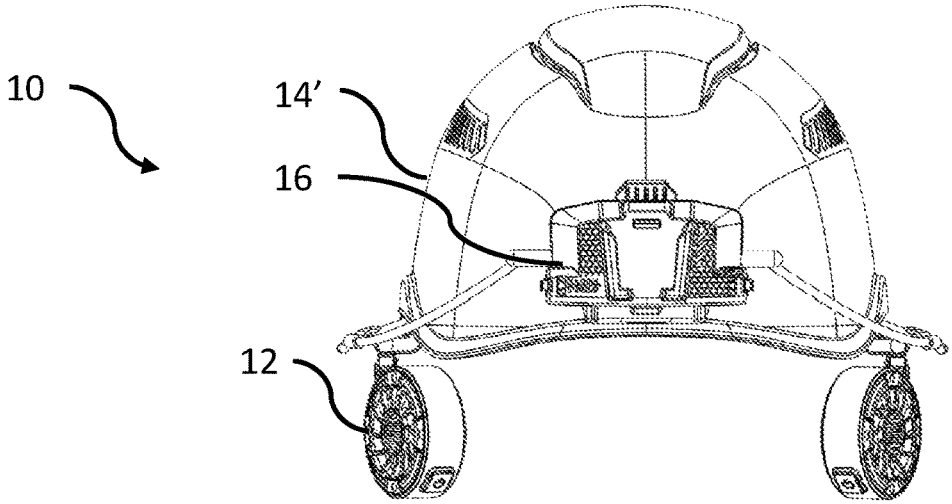
FIG. 6A is a rear view of a climber style hard hat and a pair of modular cooling fans.
Figure 6B:
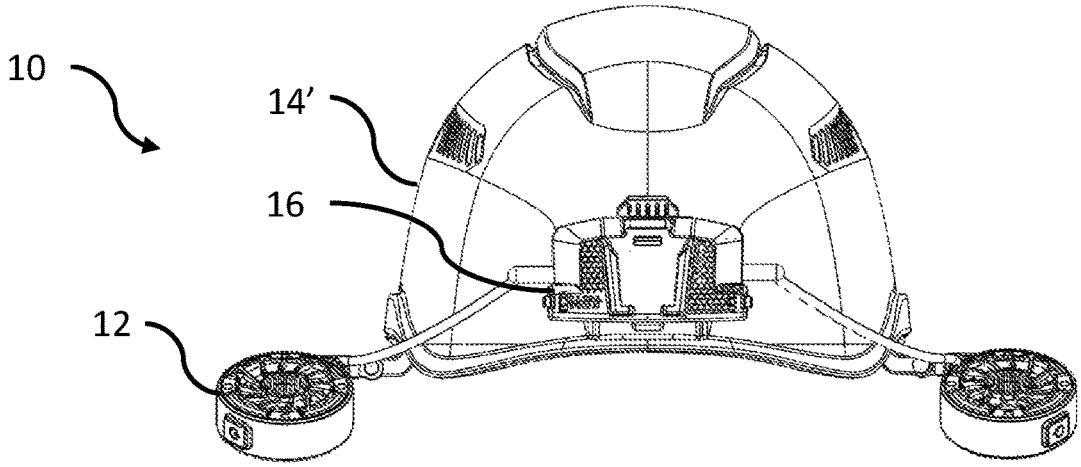
FIG. 6B is a rear view of the climber style safety helmet of FIG. 6A with the modular cooling fans in a side position.
Figure 6C:
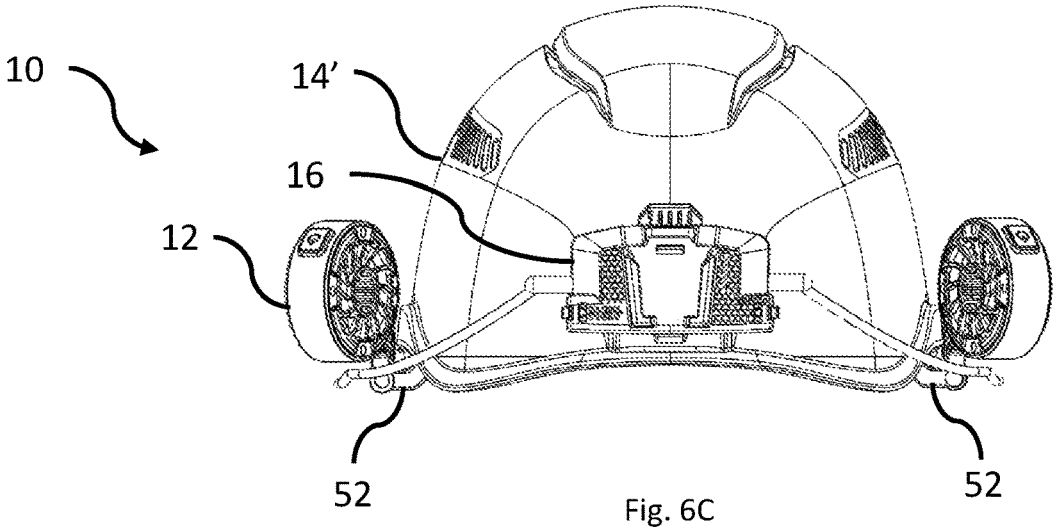
FIG. 6C is a rear view of the climber style safety helmet of FIG. 6A with the modular cooling fans in a stowed position.
Figure 7A:
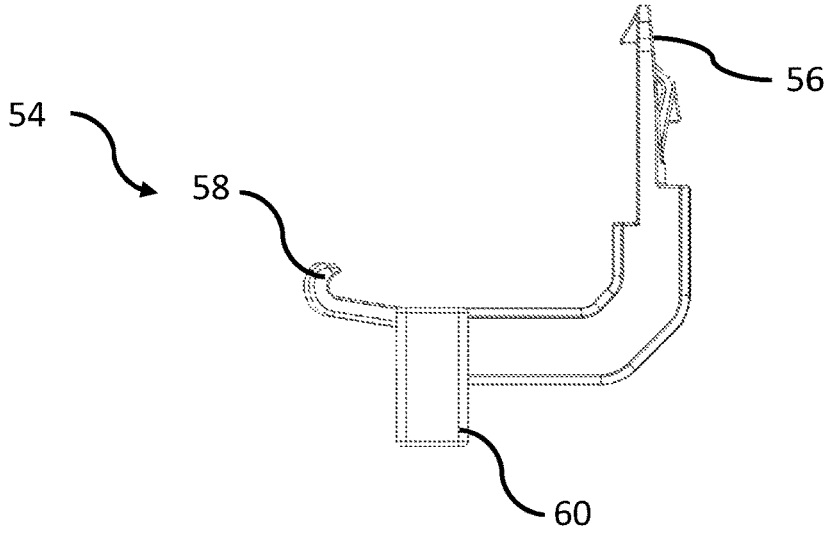
FIG. 7A is a side view of a mount adapter for a modular cooling fan.
Figure 7B:
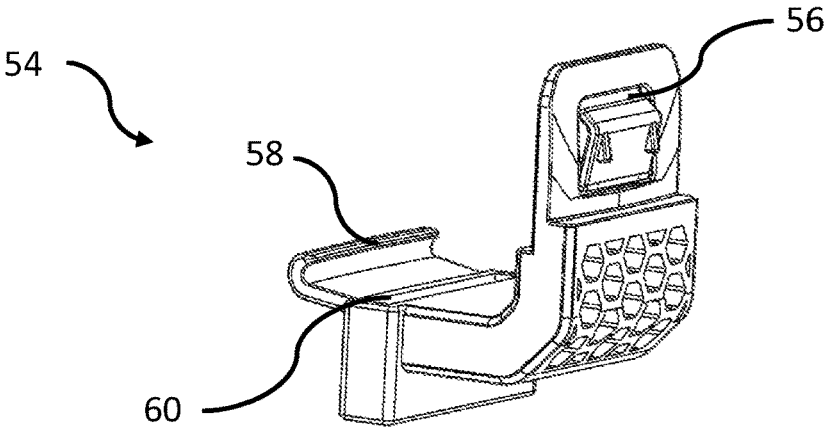
FIG. 7B is a perspective view of the mount adapter of FIG. 6A.
Figure 7C:
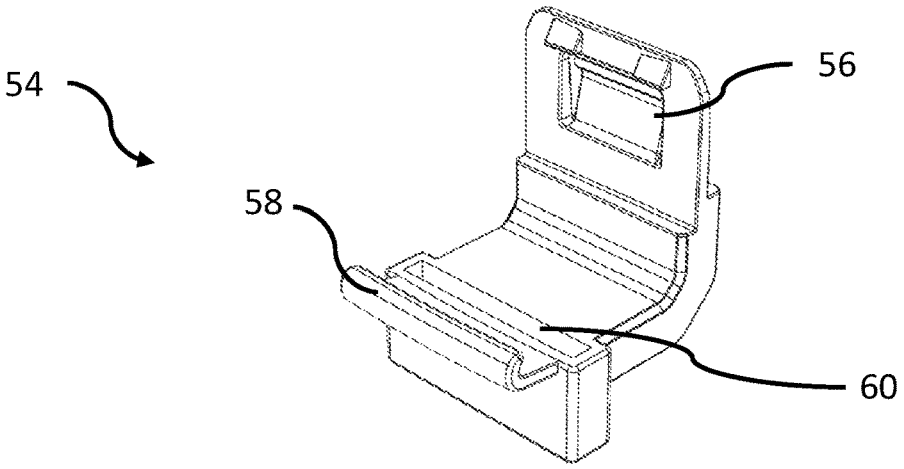
FIG. 7C is another perspective view of the mount adapter of FIG. 6A.

FIGS. 6A-6C show another embodiment of the safety helmet fan system 10 with a climber style (e.g., safety style) safety helmet 14'. In the illustrated embodiment with the climber style safety helmet 14', the brim of the helmet 14' does not typically have a protruding brim as seen in FIGS. 4A-5B. The cooling fans 12 of the illustrated and preferred embodiment may be used with any brim configuration. In the illustrated examples shown without the brim protruding outwardly from the sides of the helmets 14, 14', the cooling fan may pivot between the cooling position and the stowed position.

Figure 8A:
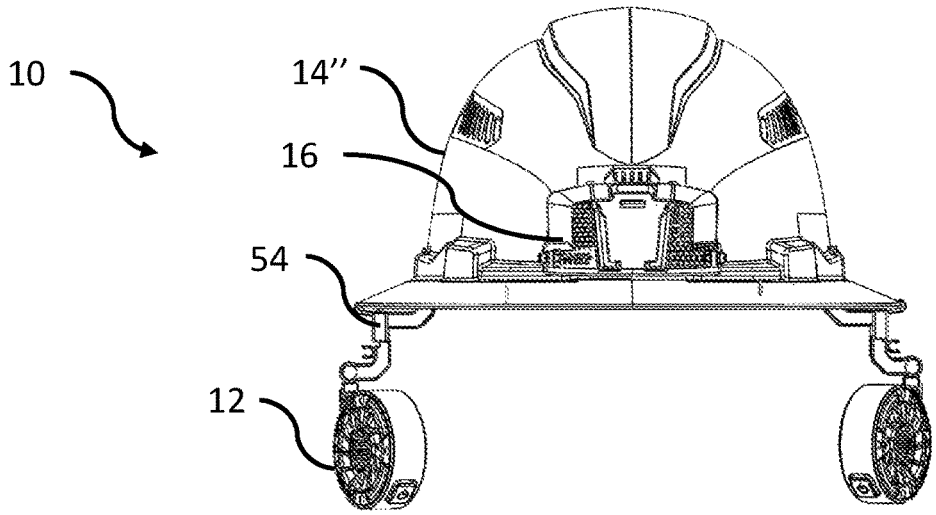
FIG. 8A is a rear view of a full brim style hard hat and a pair of modular cooling fans with mount adapters.
Figure 8B:
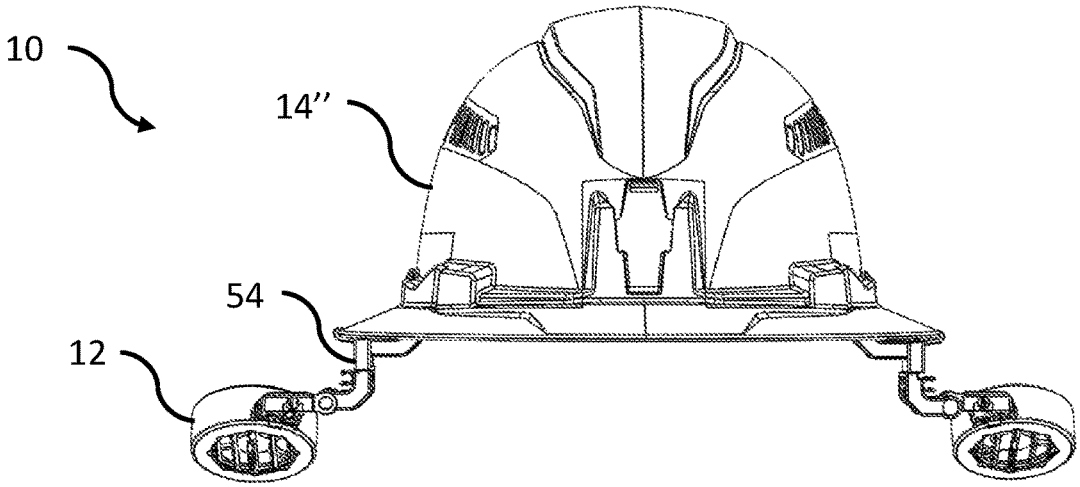
FIG. 8B is a rear view of the full brim style safety helmet of FIG. 8A with the modular cooling fans in a side position.
Figure 8C:
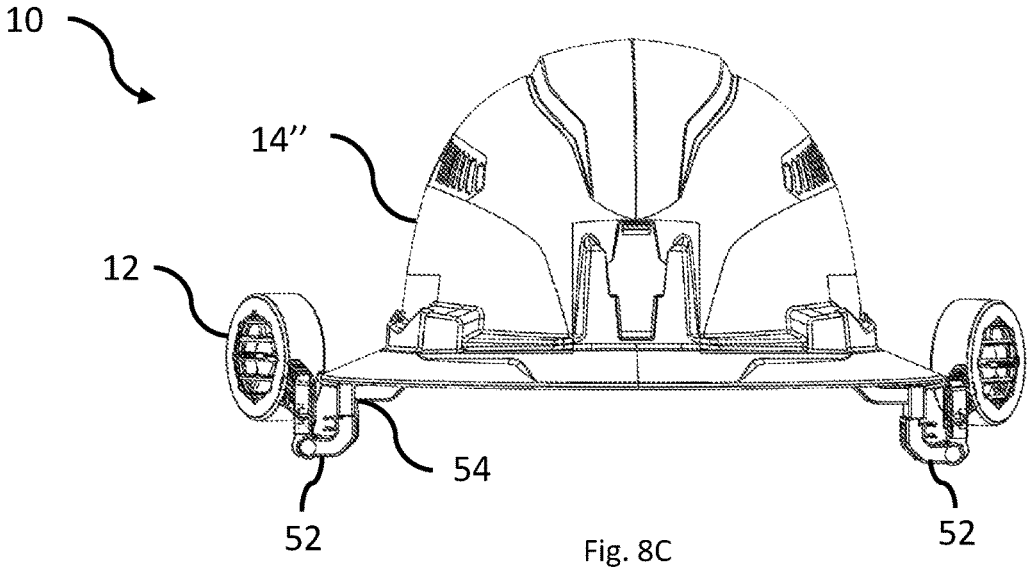
FIG. 8C is a rear view of the full brim style safety helmet of FIG. 8A with the modular cooling fans in a stowed position.

Some styles of safety helmets may include a protruding brim that extends outwardly from the sides of the helmet, such as the full brim safety helmet 14" shown in FIGS. 8A-8C. In some examples, a protruding brim may prevent the cooling fans 12 from moving to the stowed position. The cooling fans 12 shown in the illustrated embodiment of FIGS. 2A-2B shows a one-piece mount 22. In some examples a two-piece mount may be used. In the illustrated and preferred embodiment, a mount adapter 54 may be used to form a two-piece mount. The mount adapter in the illustrated and preferred embodiment, is configured to move the cooling fans 12 down and away from an associated helmet to allow the cooling fans to freely move between multiple positions (e.g., move from the cooling position to the stowed position) without a protruding brim preventing movement of the hinge connection 18.

In the illustrated and preferred embodiment, the mount adapter 54 includes an adapter clip 56 at one end, an adapter brim clip 58 at another end, and an adapter slot 60 positioned therebetween. In the illustrated and preferred embodiment, the adapter clip 56 is substantially similar to the clip 24 and is configured to engage the mount slots 42 of the safety helmet 14. In the illustrated and preferred embodiment, the brim clip 58 is shown in the form of a lip configured to engage a safety helmet brim when the mount adapter 54 is connected to a wide brim safety helmet. The adapter slot 60 is substantially similar to the mount slots 42 of the helmet and are configured to receive the clip 24 of the cooling fans 12.

In the illustrated and preferred embodiment, and as best shown in FIGS. 8A-8C, the cooling fans 12 may be used with a wide brim safety helmet 14". The mount adapters 54 are form a two-piece mount to removably attach the cooling fans to the safety helmet 14". In the illustrated and preferred embodiment, the mount adapters 54 are configured to move the mounted cooling fans 12 down and outward relative to the safety helmet 14", allowing the cooling fans to move between the cooling position of FIG. 8A and the stowed position of FIG. 8C. In the illustrated and preferred embodiment, the mount adapters 54 position the cooling fans 12 such that the brim of the safety helmet 14" does not prevent the cooling fans from rotating, via the hinge connection 18, to the stowed position.

In the illustrated embodiments, the hinge connection 18 and the louvres 27 allow a user to adjustably direct cooling air from the cooling fans 12. The plurality of rotational positions obtained by rotating about the axis of rotation of the hinge connection 18 allows adjustments to path of the cooling airflow from the fan 26. The louvres 27, which in illustrated and preferred embodiment are shown in the form of angled louvres, allow a user to further adjust the path of the cooling airflow to further finetune the airflow to the user's preference.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the safety helmet fan system 12 are shown in the figures, it should be understood that this disclosure anticipates variations in the specific details of each of the disclosed components and features of the material dispenser and that no limitation to a specific form, configuration, or detail is intended unless expressly and specifically recited in an appended claim.

For example, while in the illustrated embodiments of the safety helmet fan system 10 include a pair of cooling fans 12, in some applications a single cooling fan 12 may be used. As another example, while the safety helmets 14 are shown having a pair of mount slots 42 positioned on opposite sides of the safety helmets 14, in some examples a safety helmet 14 may include mount slots in other positions (e.g., front or rear of the safety helmet).

As a further example related to the cooling fans 12, while in most applications it will be desirable to include an elongated body 17, in some applications the hinge connection 18 may connect directly to the fan enclosure 20, providing a more compact design. While the hinge connection 18 is shown in the form of a two piece hinge formed as an integral part of the elongated body 17 and the mount, in applications other forms of mechanical rotation may be used, many of which are known (e.g., ball and socket).

As another example, while the fan 26 is shown in the form of an axial fan, in some applications other types of fans may be used (e.g., centrifugal fans). It may be desirable for the fan enclosure 20 (e.g., fan housing) to have a significantly different form and configuration if a centrifugal type fan (e.g., blower fan) is utilized instead of the illustrated axial type fan, or if multiple fans are utilized instead of the single illustrated fan, or if it is desired for the fan not to be fully enclosed as shown in the illustrated embodiments. Furthermore, it should be understood that as used herein, the term "housing" and "enclosure" is intended to cover any structure, including any frame type structure, that can carry its associated device for mounting in the safety helmet fan system 10.

As an example related to the battery pack 16, while the illustrated safety helmet fan system 10 includes an external battery pack 16, in some examples a battery may be integrated into the modular cooling fans 12. In some examples, one modular cooling fan 12 may include an integrated battery and include a power cable to power a different modular cooling fan 12.

As another example related to the mount adapter 54, while the mount adapter 54 is shown including the brim clip 58, in some applications the mount adapter 54 may not include a brim clip 58. In some examples, the mount adapter 54 may include an adjustable brim clip 58 to allow the mount adapter 54 to attach to safety helmets 14 having various brims.

As another example, while the illustrated and preferred embodiment of the safety helmet fan system 10 (e.g., as shown in FIG. 1) shows the modular cooling fans 12 extending towards the rear of the safety helmet 14, the mounts 22 are configured to allow a user to attach each of the modular cooling fans 12 to the mount slot 42 on either side of the helmet. For example, the modular cooling fan 12 on the left side, as shown in FIG. 1, may be mounted to the right side of the helmet 14 and vice versa. In this reversed position, the cooling fans 12 may be configured to extend towards the front of the user (e.g., towards the users face and away from the rear of the user's head) and allow the user to direct airflow towards their face. In an example where the safety helmet 14 is a reversable helmet (e.g., worn backwards with the front of the safety helmet 14 as shown in FIG. 4C facing behind a user), the cooling fans 12 mounted in the reverse positions direct air towards the back of the user's head and/or neck. This allows the user to use the cooling fans 12 with a reversable safety helmet 14 facing either forwards or backwards.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

What is claimed is:

1. A safety helmet fan system comprising:
a safety helmet comprising a mount slot;
a housing comprising:
a body having a fan enclosure;
a mount configured to engage the mount slot to removably attach the housing to the safety helmet; and
a hinge connecting the body to the mount;
wherein when the mount is engaged to the mount slot, the hinge is configured to allow the body to rotate, relative to the mount, between a cooling position and a stowed position; and
a motor driven fan carried in the fan enclosure;
wherein in the cooling position a rotational axis of the fan is below an axis of rotation of the hinge; and
wherein in the stowed position the rotational axis of the fan is above the axis of rotation of the hinge.

2. The safety helmet fan system of claim 1, wherein the mount is a unitary structure.

3. The safety helmet fan system of claim 1, wherein the mount is of two-piece construction, wherein a first piece of the mount comprises a releasable connection configured to engage a slot of the second piece of the mount.

4. The safety helmet fan system of claim 1, wherein the safety helmet comprises a protruding brim, and wherein the mount is configured to engage the protruding brim.

5. The safety helmet fan system of claim 1, wherein the fan enclosure comprises louvres configured to allow the user to adjustably direct air from the fan.

6. The safety helmet fan system of claim 1, further comprising:
a battery configured to mount to an exterior of the safety helmet, and
a power cable permanently connected to the housing and removably connected to the battery.

7. The safety helmet fan system of claim 6, wherein the mount includes a first clip configured to removably attach to the power cable, the safety helmet fan system further comprising a second clip having a first portion attached to the power cable and second portion configured to removably attach to a brim of the safety helmet.

8. The safety helmet fan system of claim 1, wherein:
the safety helmet further comprises a second mount slot on a side of the safety helmet opposite the mount slot; and
the safety helmet fan system further comprises a second housing having a second fan housing and second mount configured to engage the second mount slot.

9. The safety helmet fan system of claim 8, wherein the mount slot is positioned on a first side the safety helmet and the second mount slot is positioned on a second side of the safety helmet opposite the first side.

10. The safety helmet fan system of claim 1, wherein the mount comprises a clip configured to engage the mount slot to removably attach the housing to the safety helmet.

11. The safety helmet fan system of claim 1, wherein a first portion of the hinge is an integral part of the body and a second portion of the hinge is an integral portion of the mount.

12. The safety helmet fan system of claim 1, wherein the mount comprises a substantially flat support surface configured to support the safety helmet fan system in the stowed position.

13. A safety helmet fan system comprising:

a safety helmet comprising a mount slot;

a housing comprising:

an elongated body having a fan enclosure at a first end;

a mount configured to engage the mount slot to removably attach the housing to the safety helmet; and a hinge connecting a second end of the elongated body, opposite the first end, to the mount;

wherein when the mount is engaged to the mount slot, the hinge is configured to allow the body to rotate, relative to the mount, between a first position and a second position;

a motor driven fan carried in the fan enclosure; and angled louvres carried on the fan enclosure and configured to adjustably redirect air movement from the motor driven fan;

wherein in the first position an outlet of the fan enclosure is directed in a first direction; and wherein in the second position the fan enclosure is directed in a second direction different from the first direction.

14. The safety helmet fan system of claim 13 wherein in the first position a rotational axis of the fan is below an axis of rotation of the hinge, and wherein in the second position the rotational axis of the fan is above the axis of rotation of the hinge.

15. The safety helmet fan system of claim 14, wherein the mount comprises a substantially flat support surface configured to support the safety helmet fan system in the second position.

16. The safety helmet fan system of claim 13, wherein the louvres are configured to rotate relative to the fan enclosure to adjustably direct the airflow from the fan.

* * * * *